US009451355B1

(12) United States Patent
Jankovsky et al.

(10) Patent No.: US 9,451,355 B1
(45) Date of Patent: Sep. 20, 2016

(54) DIRECTIONAL ACOUSTIC DEVICE

(71) Applicant: Bose Corporation, Framingham, MA (US)

(72) Inventors: Joseph Jankovsky, Holliston, MA (US); Christopher B. Ickler, Sudbury, MA (US); Joseph A. Coffey, Jr., Hudson, MA (US)

(73) Assignee: Bose Corporation, Framingham, MA (US)

( * ) Notice: Subject to any disclaimer, the term of this patent is extended or adjusted under 35 U.S.C. 154(b) by 52 days.

(21) Appl. No.: 14/674,072

(22) Filed: Mar. 31, 2015

(51) Int. Cl.
*H04R 25/00* (2006.01)
*H04R 1/34* (2006.01)

(52) U.S. Cl.
CPC ..... *H04R 1/345* (2013.01)

(58) Field of Classification Search
CPC ..... H04R 1/345; H04R 7/045; G10K 11/26; G10K 15/04
USPC ..... 381/377, 387, 395, 398, 152, 111; 181/173, 144, 167, 157
See application file for complete search history.

(56) References Cited

U.S. PATENT DOCUMENTS 582,147 A 5/1897 Riley
1,387,490 A 8/1921 Humes
1,577,880 A 3/1926 Stuart (Continued)

FOREIGN PATENT DOCUMENTS

EP 0608937 A1 8/1994
EP 0624045 11/1994

(Continued)

OTHER PUBLICATIONS

Augspurger, G.L., Loudspeakers on Damped Pipes, J. Audio Eng. Soc., vol. 48, No. 5, May 2000, pp. 424-436, Perception Inc., Los Angeles, CA.

(Continued)

*Primary Examiner* — Quoc D Tran
*Assistant Examiner* — Julie X Dang
(74) *Attorney, Agent, or Firm* — Brian M. Dingman; Dingman IP Law, PC

(57) ABSTRACT

A directional acoustic device that has an acoustic source or an acoustic receiver, and a conduit to which the acoustic source or acoustic receiver is acoustically coupled and within which acoustic energy travels in a propagation direction from the acoustic source or to the acoustic receiver, the conduit having finite extent at which the conduit structure ends. The conduit has a radiating portion that has a radiating surface with leak openings that define controlled leaks through which acoustic energy radiated from the source into the conduit can leak to the outside environment or through which acoustic energy in the outside environment can leak into the conduit. The only path for acoustic energy in the conduit to reach the external environment or acoustic energy in the external environment to enter the conduit is through the controlled leaks. The leak openings define leaks having a first extent in the propagation direction, and also define leaks having a second extent at locations along the conduit with a constant time delay relative to the location of the source or receiver. The extents of the leaks are determinative of the lowest frequency where useful directivity control is obtained. The lowest frequency of directivity control for the leak in the propagation direction is within three octaves of the lowest frequency of directivity control for the leak with constant time delay.

24 Claims, 13 Drawing Sheets

(56) References Cited

U.S. PATENT DOCUMENTS 1,755,636 A 4/1930 Dubilier
1,840,992 A 1/1932 Weitling
2,225,312 A 12/1940 Mason
2,293,181 A 8/1942 Terman
2,318,535 A 5/1943 Spivak
2,566,094 A 8/1951 Olson et al.
2,739,659 A 3/1956 Daniels
2,789,651 A 4/1957 Daniels
2,856,022 A 10/1958 Kurtze et al.
2,913,680 A 11/1959 Porter et al.
2,939,922 A 6/1960 Gorike
3,174,578 A 3/1965 Kojima
3,378,814 A 4/1968 Butler
3,381,773 A 5/1968 Schenkel
3,486,578 A 12/1969 Albariono
3,517,390 A 6/1970 Whitehead
3,555,956 A 1/1971 Martin
3,657,490 A 4/1972 Scheiber
3,768,589 A 10/1973 Nilsson et al.
3,930,560 A 1/1976 Carlson et al.
3,940,576 A 2/1976 Schultz
3,944,757 A 3/1976 Tsukamoto
3,978,941 A 9/1976 Siebert
4,171,734 A 10/1979 Peveto et al.
4,251,686 A 2/1981 Sokolich
4,297,538 A 10/1981 Massa
4,340,778 A 7/1982 Cowans et al.
4,340,787 A 7/1982 Gorike
4,373,606 A 2/1983 Clements et al.
4,421,957 A 12/1983 Wallace, Jr.
4,546,459 A 10/1985 Congdon
4,586,194 A 4/1986 Kohashi et al.
4,616,731 A 10/1986 Robinson
4,628,528 A 12/1986 Bose et al.
4,646,872 A 3/1987 Kamon et al.
4,706,295 A 11/1987 Putnam et al.
4,747,142 A 5/1988 Tofte
4,757,546 A 7/1988 Akino
4,930,596 A 6/1990 Saiki et al.
4,942,939 A 7/1990 Harrison
4,965,776 A 10/1990 Mueller
5,012,890 A 5/1991 Nagi et al.
5,022,486 A 6/1991 Miura et al.
5,105,905 A 4/1992 Rice
5,109,422 A 4/1992 Furukawa
5,137,110 A 8/1992 Bedard, Jr. et al.
5,170,435 A 12/1992 Rosen et al.
5,187,333 A 2/1993 Adair
5,197,100 A 3/1993 Shiraki
5,197,103 A 3/1993 Hayakawa
5,261,006 A 11/1993 Nieuwendijk et al.
5,276,740 A 1/1994 Inanaga et al.
5,280,229 A 1/1994 Faude et al.
5,325,435 A 6/1994 Date et al.
5,373,564 A 12/1994 Spear et al.
5,375,564 A 12/1994 Gail
5,426,702 A 6/1995 Aarts
5,524,062 A 6/1996 Oh
5,528,694 A 6/1996 Van De Kerkhof et al.
5,610,992 A 3/1997 Hickman
5,673,329 A 9/1997 Wiener
5,732,145 A 3/1998 Tsao et al.
5,740,259 A 4/1998 Dunn
5,792,000 A 8/1998 Weber et al.
5,793,000 A 8/1998 Sabato et al.
5,802,194 A 9/1998 Yamagishi et al.
5,809,153 A 9/1998 Aylward et al.
5,815,589 A 9/1998 Wainwright et al.
5,821,471 A 10/1998 McCuller
5,828,759 A 10/1998 Everingham
5,832,099 A 11/1998 Wiener
5,854,450 A 12/1998 Kent
5,864,100 A 1/1999 Newman
5,870,484 A 2/1999 Greenberger
5,881,989 A 3/1999 O'Brien et al.
5,898,137 A 4/1999 Saito
5,929,392 A 7/1999 Sabato et al.
5,940,347 A 8/1999 Raida et al.
5,956,411 A 9/1999 Edgar
6,002,781 A 12/1999 Takayama et al.
6,005,952 A 12/1999 Klippel
6,067,362 A 5/2000 Lemanski et al.
6,075,868 A 6/2000 Goldfarb et al.
6,144,751 A 11/2000 Velandia
6,158,902 A 12/2000 Staat
6,173,064 B1 1/2001 Anagnos
6,223,853 B1 5/2001 Huon et al.
6,255,800 B1 7/2001 Bork
6,275,595 B1 8/2001 Lundgren et al.
6,278,789 B1 8/2001 Potter
6,356,643 B2 3/2002 Yamagishi et al.
6,359,994 B1 3/2002 Markow et al.
6,374,120 B1 4/2002 Krauss
6,411,718 B1 6/2002 Danley et al.
6,415,036 B1 7/2002 Ritter et al.
6,431,309 B1 8/2002 Coffin
6,477,042 B1 11/2002 Allgeyer et al.
6,597,794 B2 7/2003 Cole et al.
6,694,200 B1 2/2004 Naim
6,704,425 B1 3/2004 Plummer
6,741,717 B2 5/2004 Dedieu et al.
6,744,903 B1 6/2004 Jeon et al.
6,771,787 B1 8/2004 Hoefler et al.
6,820,431 B2 11/2004 McManus et al.
6,870,933 B2 3/2005 Roovers
6,928,169 B1 8/2005 Aylward
6,963,647 B1 11/2005 Krueger et al.
7,016,501 B1 3/2006 Aylward et al.
7,155,214 B2 12/2006 Struthers et al.
7,212,467 B2 5/2007 Dobbins
7,283,634 B2 10/2007 Smith
7,426,280 B2 9/2008 Aylward
7,490,044 B2 2/2009 Kulkarni
7,536,024 B2 5/2009 Bailey et al.
7,542,815 B1 6/2009 Berchin
7,623,670 B2 11/2009 Hoefler et al.
7,747,033 B2 6/2010 Uchimura
7,751,582 B2 7/2010 Akino
D621,439 S 8/2010 Hamanaga
7,826,633 B2 11/2010 Davi
7,833,282 B2 11/2010 Mandpe
7,835,537 B2 11/2010 Cheney
7,848,535 B2 12/2010 Akino
8,066,095 B1 11/2011 Bromer
8,175,311 B2 5/2012 Aylward
8,351,630 B2 1/2013 Ickler et al.
8,358,798 B2 1/2013 Ickler et al.
8,447,055 B2 5/2013 Jankovsky et al.
8,953,831 B2 2/2015 Jankovsky et al.
2001/0001319 A1 5/2001 Beckert et al.
2001/0031059 A1 10/2001 Borgonovo
2001/0039200 A1 11/2001 Azima et al.
2002/0073252 A1 6/2002 Arbiter et al.
2002/0085730 A1 7/2002 Holland
2002/0085731 A1 7/2002 Aylward
2002/0115480 A1 8/2002 Huang
2002/0150261 A1 10/2002 Moeller et al.
2002/0171567 A1 11/2002 Altare et al.
2002/0194897 A1 12/2002 Arnott et al.
2003/0063767 A1 4/2003 Dedieu et al.
2003/0095672 A1 5/2003 Hobelsberger
2003/0164820 A1 9/2003 Kent
2004/0105559 A1 6/2004 Aylward et al.
2004/0173175 A1 9/2004 Kostun et al.
2004/0204056 A1 10/2004 Phelps
2004/0234085 A1 11/2004 Lennox
2005/0013457 A1 1/2005 Sheplak et al.
2005/0018839 A1 1/2005 Weiser
2005/0036642 A1 2/2005 Hoefler et al.
2005/0078831 A1 4/2005 Irwan et al.
2005/0205348 A1 9/2005 Parker et al.
2005/0205349 A1 9/2005 Parker et al.
2005/0239434 A1 10/2005 Marlowe
2005/0254681 A1 11/2005 Bailey et al.

(56) References Cited

U.S. PATENT DOCUMENTS

| | | | |
|---|---|---|---|
| 2005/0255895 | A1 | 11/2005 | Lee et al. |
| 2006/0013411 | A1 | 1/2006 | Lin |
| 2006/0046778 | A1 | 3/2006 | Hembree |
| 2006/0046780 | A1 | 3/2006 | Subramaniam et al. |
| 2006/0065479 | A1 | 3/2006 | Okawa et al. |
| 2006/0134959 | A1 | 6/2006 | Ellenbogen |
| 2006/0181840 | A1 | 8/2006 | Cvetko |
| 2006/0250764 | A1 | 11/2006 | Howarth et al. |
| 2006/0253879 | A1 | 11/2006 | Lin |
| 2006/0274913 | A1 | 12/2006 | Akino |
| 2006/0285714 | A1 | 12/2006 | Akino |
| 2007/0002533 | A1 | 1/2007 | Kogan et al. |
| 2007/0014426 | A1 | 1/2007 | Sung et al. |
| 2007/0015486 | A1 | 1/2007 | Marlowe |
| 2007/0035917 | A1 | 2/2007 | Hotelling et al. |
| 2007/0036384 | A1 | 2/2007 | Struthers et al. |
| 2007/0086606 | A1 | 4/2007 | Goodwin |
| 2007/0086615 | A1 | 4/2007 | Cheney |
| 2007/0217633 | A1 | 9/2007 | Copeland et al. |
| 2007/0226384 | A1 | 9/2007 | Robbin et al. |
| 2007/0233036 | A1 | 10/2007 | Mandpe |
| 2007/0239849 | A1 | 10/2007 | Robbin et al. |
| 2007/0247794 | A1 | 10/2007 | Jaffe et al. |
| 2007/0269071 | A1 | 11/2007 | Hooley |
| 2007/0286427 | A1 | 12/2007 | Jung et al. |
| 2008/0152181 | A1 | 6/2008 | Parker et al. |
| 2008/0232197 | A1 | 9/2008 | Kojima et al. |
| 2009/0003613 | A1 | 1/2009 | Christensen |
| 2009/0003639 | A1 | 1/2009 | Aylward |
| 2009/0016555 | A1 | 1/2009 | Lynnworth |
| 2009/0157575 | A1 | 6/2009 | Schobben et al. |
| 2009/0208047 | A1 | 8/2009 | Ngia et al. |
| 2009/0209304 | A1 | 8/2009 | Ngia et al. |
| 2009/0214066 | A1 | 8/2009 | Parker et al. |
| 2009/0225992 | A1 | 9/2009 | Konagai |
| 2009/0226004 | A1 | 9/2009 | Sorensen |
| 2009/0252363 | A1 | 10/2009 | Ickler |
| 2009/0274313 | A1 | 11/2009 | Klein et al. |
| 2009/0274329 | A1 * | 11/2009 | Ickler ..... H04R 1/345 381/338 |
| 2009/0304189 | A1 | 12/2009 | Vinton |
| 2009/0323995 | A1 | 12/2009 | Sibbald |
| 2010/0092019 | A1 | 4/2010 | Hoefler et al. |
| 2010/0224441 | A1 | 9/2010 | Fujimori et al. |
| 2010/0290630 | A1 | 11/2010 | Berardi et al. |
| 2011/0026744 | A1 | 2/2011 | Jankovsky et al. |
| 2011/0028986 | A1 | 2/2011 | Mandpe |
| 2011/0096950 | A1 | 4/2011 | Rougas et al. |
| 2011/0206228 | A1 | 8/2011 | Shiozawa et al. |
| 2011/0219936 | A1 | 9/2011 | Masuda et al. |
| 2011/0305359 | A1 | 12/2011 | Ikeda et al. |
| 2012/0039475 | A1 | 2/2012 | Berardi et al. |
| 2012/0057736 | A1 | 3/2012 | Shiozawa et al. |
| 2012/0121118 | A1 | 5/2012 | Fregoso et al. |
| 2012/0237070 | A1 | 9/2012 | Ickler et al. |

FOREIGN PATENT DOCUMENTS

| | | | |
|---|---|---|---|
| EP | 1185094 | A2 | 3/2002 |
| EP | 1487233 | A1 | 12/2004 |
| EP | 1527801 | A3 | 5/2005 |
| EP | 1577880 | | 9/2005 |
| EP | 1921890 | A2 | 5/2008 |
| EP | 2099238 | A1 | 9/2009 |
| EP | 2104375 | A2 | 9/2009 |
| FR | 844769 | A | 8/1939 |
| FR | 1359616 | A | 4/1964 |
| FR | 2653630 | A1 | 4/1991 |
| GB | 22965 | | 0/1908 |
| GB | 310493 | A | 1/1930 |
| GB | 631799 | A | 11/1949 |
| GB | 1159613 | A | 7/1969 |
| GB | 2100551 | A | 12/1982 |
| GB | 2432213 | A | 5/2007 |
| JP | 55165097 | A | 12/1980 |
| JP | 4-336795 | A | 11/1992 |
| JP | 2007037058 | A | 2/2007 |
| WO | 9611558 | A1 | 4/1996 |
| WO | 9820659 | A1 | 5/1998 |
| WO | 9851122 | A1 | 11/1998 |
| WO | 2004075601 | A1 | 9/2004 |
| WO | 2005/104655 | A2 | 11/2005 |
| WO | 2006/130115 | A1 | 12/2006 |
| WO | 2007007083 | A1 | 1/2007 |
| WO | 2007/031703 | A1 | 3/2007 |
| WO | 2007/049075 | A1 | 5/2007 |
| WO | 2007/052185 | A2 | 5/2007 |
| WO | 2009105313 | A1 | 8/2009 |
| WO | 2009134591 | A1 | 11/2009 |

OTHER PUBLICATIONS

European Examination Report dated Jul. 21, 2008 for EP Appln. No. 02026327.3.

Japanese Office Action dated Feb. 23, 2009 for related JP Application No. H11-250309.

International Preliminary Report on Patentability dated Feb. 18, 2010 for PCT/US2009/032241.

Baily, A. R. "Non-resonant Loudspeaker Enclosure Design", Wireless World, Oct. 1965.

International Preliminary Report on Patentability dated May 19, 2010 for PCT/US2009/032241.

International Preliminary Report on Patentability dated Jul. 16, 2010 for PCT/US2009/039709.

CN OA dated Aug. 27, 2010 for CN Appln. No. 200710089694.0.

Backgrounder; Technical Overview: Zenith/Bose Television Sound System, Summer/Fall 1986, Zenith Electronics Corporation, 1000 Milwaukee Avenue, Glenview, Illinois 60025, 8 pages.

International Search Report and Written Opinion dated Apr. 27, 2011 for PCT/US2011/024674.

International Search Report and Written Opinion dated Nov. 2, 2011 for PCT/US2011/047429.

JP OA dated Dec. 13, 2011 for JP Appln. No. 2010-546815.

English Translation of Abstract for JP Patent 336795, published Nov. 24, 1992.

International Search Report and Written Opinion dated Feb. 3, 2012 for PCT US2011/052347.

Australian Examiner's first report on Australian Patent Application 2009215768, dated Jan. 20, 2012.

Second Chinese Office Action on Chinese Patent Application 200710089694.0, dated Feb. 13, 2012.

First Chinese Office Action dated Dec. 31, 2012 for Chinese Patent Application No. 200980114910.X.

International Preliminary Report on Patentability dated Feb. 21, 2013 for PCT/US2011/047429.

First Chinese Office Action dated Dec. 31, 2012 for Chinese Patent Application No. 200980114910.X (with English translation).

Fourth Chinese Office Action dated Feb. 22, 2013 for Chinese Application No. 200710089694.0.

Harrell, Jefferson, "Constant Beamwidth One-Octave Bandwidth End-Fire Line Array Loudspeakers", JAES vol. 13, No. 7/8, Jul./Aug. 1995.

Mieier, et al.; Ein linienhafter akustischer Gruppenstrahler mit ausgeglichenen Nebenmaxima, Acustica vol. 17 1966, pp. 301-309.

Holland, K. R., et al., A Low Cost End-Fire Acoustic Radiator, Institute of Sound and Vibration Research, University of Southampton, Southampton S095NH, UK, J. Audio Eng. Soc., vol. 39, No. 7/8, Jul./Aug. 1991, pp. 540-550.

Reams, et al., The Karlson-Hypex Bass Enclosure, AES, An Audio Engineering Society Preprint, presented at the 57th Convention, May 10-13, 1977, Los Angeles, CA.

Olson, Harry F., Directional Microphones, Journal of the Audio Engineering Society, RCA Laboratories, Princeton, NJ, pp. 420-430.

Poppe, Martin C., The K-Coupler, A New Acoustical-Impedance Transformer, IEEE Transactions on Audio and Electroacoustics, pp. 163-167, Dec. 1966.

(56) References Cited

OTHER PUBLICATIONS

Korn, T.S., A Corner Loudspeaker with Coaxial Acoustical Line, Journal of the Audio Engineering Society, vol. 5, No. 3, Jul. 1957, pp. 138-141.
Ramsey, Robert C., A New Cardiod-Line Mircrophone, Audio Engineering Society, NY, NY, Oct. 5-9, 1959.
Shulman, Yuri, Reducing Off-Axis Comb Filter Effects in Highly Directional Microphones, Audio Engineering Society, Presented at the 81st Convention, Los Angeles, CA, Nov. 12-16, 1986.
Purolator Acoustic Porous Metals, Acoustic Media for Aviation Applications, Aerospace Acoustic Materials, Acoustic Media for Helicopters, pp. 1-4, http://www.purolator-facet.com/acoustic.htm, May 1, 2008.
www.altecmm.com, Oct. 2003, inMotion portable audio stereo.
www.pcstats.com, Jun. 21, 2004, NoiseControl Novibes III HDD Isolation.
www.reviews.cnet.com, Jul. 23, 2004, Creative Travel sound.
www.jbl.com, Jul. 23, 2004, Creative Travel Sound.
www.earsc.com, Jun. 28, 2004, Stereo Speaker.
Steve Guttenberg, "Altec Lansing InMotion", Internet Citation (online) Jun. 10, 2004 (downloaded Nov. 11, 2006) URL: http:// reviews .cnet.com/4505-7869 7-30790793.html.
EP05107420.1 European Search Report dated Nov. 20, 2006.
International Search Report and Written Opinion dated Jul. 15, 2009 for PCT/US2009/039709.
Boone, Marinus, M. et al; "Design of a Highly Directional Endfire Loudspeaker Array". J. Audio Eng. Doc., vol. 57, No. 5, May 2009. pp. 309-325.
Van Der Wal, Menno, et al.; "Design of Logarithmically Spaced Constant-Directivity Transducer Arrays". J. Audio Eng. Soc., vol. 44, No. 6, Jun. 1996. pp. 497-507.
Ward, Darren B., et al.; "Theory and Design of Broadband Sensor Arrays with Frequency Invariant Far-field Beam Patterns". J. Acounstic Soc. Am. 97 (2), Feb. 1995. pp. 1023-1034.
Moulton Dave, The Center Channel: Unique and Difficult; TV Technology, Published Oct. 5, 2005. Retrieved May 13, 2009 from: http://www.tvtechnology.com/article/11798.
Rubinson Kalman, Music in the Round #4, Stereophile, Published Mar. 2004; Retrieved May 13, 2009 from http://www.stereophile.com/musicintheround/304round/.
Silva Robert, Surround Sound—What You Need to Know, The History and Basics of Surround Sound, Retrieved May 13, 2009 from http://hometheaterabout.com/od/beforeyoubuy/a/surroundsound.htm.
Linkwitz Siegfried, Surround Sound, Linkwitz Lab, Accurate Reproduction and Recording of Auditory Scenes, Revised Publication Jan. 15, 2009. Retreived May 13, 2009 from http://www.linkwitzlab.com/surround_system.htm.
International Search Report and Written Opinion dated Apr. 28, 2009 for PCT/US2009/032241.
Munjal, M. L., Acoustics of Ducts and Mufflers with Application to Exhaust and Ventilation System Design, 1987, pp. 42-152, John Wiley & Sons, New York, NY.
The International Search Report and the Written Opinion of the International Searching Authority issued on Jun. 24, 2016 for corresponding PCT Application No. PCT/US2016/024786.

* cited by examiner

DIRECTIONAL ACOUSTIC DEVICE

BACKGROUND

This disclosure relates to directional acoustic devices including acoustic sources and acoustic receivers.

Directional acoustic devices can control the directivity of radiated or received acoustic energy.

SUMMARY

All examples and features mentioned below can be combined in any technically possible way.

In one aspect a directional acoustic device includes an acoustic source or an acoustic receiver, and a conduit to which the acoustic source or acoustic receiver is acoustically coupled and within which acoustic energy travels in a propagation direction from the acoustic source or to the acoustic receiver, the conduit having finite extent at which the conduit structure ends. The conduit has a radiating portion that has a radiating surface with leak openings that define controlled leaks through which acoustic energy radiated from the source into the conduit can leak to the outside environment or through which acoustic energy in the outside environment can leak into the conduit. The only path for acoustic energy in the conduit to reach the external environment or acoustic energy in the external environment to enter the conduit is through the controlled leaks. The leak openings define leaks having a first extent in the propagation direction, and also define leaks having a second extent at locations along the conduit with a constant time delay relative to the location of the source or receiver. The extents of the leaks are determinative of the lowest frequency where useful directivity control is obtained. The lowest frequency of directivity control for the leak in the propagation direction is within three octaves of the lowest frequency of directivity control for the leak with constant time delay.

Embodiments may include one of the following features, or any combination thereof. The radiating portion of the conduit may be generally planar. The radiating portion of the conduit may have an end that lies along a circular arc. The radiating portion of the conduit may be a circular sector. The radiating portion may lie generally in a plane, and the source or receiver may be located in the plane of the radiating portion. The radiating portion may lie generally in a plane, and the source or receiver may not be located in the plane of the radiating portion. The radiating portion may be curved to form a three-dimensional shell.

Embodiments may include one of the following features, or any combination thereof. The area of the leak openings that define leaks in the propagation direction may vary as a function of distance from the location of the acoustic source or receiver. The acoustic resistance of the leak openings that define leaks in the propagation direction may vary as a function of distance from the location of the acoustic source or receiver. The variation in acoustic resistance may be accomplished at least in part by one or both of: varying the area of the leak as a function of distance from the source or receiver; and by varying the acoustical resistance of the leak as a function of distance from the source or receiver. The variation in acoustic resistance may be accomplished at least in part by one or both of: placing a material with spatially varying acoustical resistance over a leak opening in the perimeter with constant area as a function of distance from the source or receiver; and by varying the leak area as a function of distance from the source or receiver and applying a material with constant acoustical resistance over the leak.

Embodiments may include one of the following features, or any combination thereof. The depth of the conduit, at locations where the time delay relative to the source or receiver location is constant, may decrease as a function of distance from the source or receiver location. The area of the leak openings that define constant time delay leaks may be between about one and four times the area of the leak openings that define leaks in the propagation direction. The extent of the fixed time delay leak may be at least about ½ wavelength of sound at the lowest frequency that it is desired to control directivity. The extent of the leak in the propagation direction may be at least about ¼ wavelength of sound at the lowest frequency that it is desired to control directivity. The ratio of the first extent to the second extent may be less than 6.3 and greater than 0.25

Embodiments may include one of the following features, or any combination thereof. The leak openings may be all in one surface of the conduit. The conduit may be mounted to the ceiling of a room, and the surface with leaks may face the floor of the room. The conduit may be mounted on a wall of a room and the surface with leaks may face the floor of the room. For a radiating device, substantially all of the acoustic energy radiated into the conduit may leak through the controlled leaks to the outside environment before it reaches the end of the conduit structure.

In another aspect a directional acoustic device includes an acoustic source or an acoustic receiver, and a conduit to which the acoustic source or acoustic receiver is acoustically coupled and within which acoustic energy travels in a propagation direction from the acoustic source or to the acoustic receiver, the conduit having finite extent at which the conduit structure ends. The conduit has a radiating portion that has a radiating surface with leak openings that define controlled leaks through which acoustic energy radiated from the source into the conduit can leak to the outside environment or through which acoustic energy in the outside environment can leak into the conduit. The only path for acoustic energy in the conduit to reach the external environment or acoustic energy in the external environment to enter the conduit is through the controlled leaks. The radiating portion of the conduit expands radially out from the location of the source over a subtended angle that is at least 15 degrees. The depth of the conduit may decrease as distance from the acoustic source increases.

In another aspect a directional acoustic device includes an acoustic source or an acoustic receiver, and a conduit to which the acoustic source or acoustic receiver is acoustically coupled and within which acoustic energy travels in a propagation direction from the acoustic source or to the acoustic receiver, the conduit having finite extent at which the conduit structure ends. The conduit has a radiating portion that has a radiating surface with leak openings that define controlled leaks through which acoustic energy radiated from the source into the conduit can leak to the outside environment or through which acoustic energy in the outside environment can leak into the conduit. The only path for acoustic energy in the conduit to reach the external environment or acoustic energy in the external environment to enter the conduit is through the controlled leaks. The leak openings define leaks having a first extent in the propagation direction, and also define leaks having a second extent at locations along the conduit with a constant, maximum time delay relative to the location of the source or receiver. The ratio of the first extent to the second extent is less than 6.3 and greater than 0.25.

DETAILED DESCRIPTION

One or more acoustic sources or acoustic receivers are coupled to a hollow structure such as an arbitrarily shaped conduit that contains acoustic radiation from the source(s) and conducts it away from the source, or conducts acoustic energy from outside the structure through the structure and to the receiver. The structure has a perimeter wall that is constructed and arranged to allow acoustic energy to leak through it (out of it or into it) in a controlled manner. The perimeter wall forms a 3D surface in space. Much of the discussion relative to FIGS. 1-10 concerns a directionally radiating acoustic device. However, the discussion also applies to directionally receiving acoustic devices in which receivers (e.g., microphone elements) replace the acoustic sources. In a receiver, radiation enters the structure through the leaks and is conducted to the receiver.

The magnitude of the acoustic energy leaked through a leak (i.e., out of the conduit through the leak or into the conduit through the leak) at an arbitrary point on the perimeter wall depends on the pressure difference between the acoustic pressure within the conduit at the arbitrary point and the ambient pressure present on the exterior of the conduit at the arbitrary point, and the acoustical impedance of the perimeter wall at the arbitrary point. The phase of the leaked energy at the arbitrary point relative to an arbitrary reference point located within the conduit depends on the time difference between the time it takes sound radiated from the source into the conduit to travel from the source through the conduit to the arbitrary reference point and the time it takes sound to travel through the conduit from the source to the selected arbitrary point. Though the reference point could be chosen to be anywhere within the conduit, for future discussions the reference point is chosen to be the location of the source such that the acoustic energy leaked through any point on the conduit perimeter wall will be delayed in time relative to the time the sound is emitted from the source. For a receiver configured to receive acoustic output from a source located external to the conduit, the phase of the sound received at any first point along the leak surface relative to any second point along the leak surface is a function of the relative difference in time it takes energy emitted from the external acoustic source to reach the first and second points. The relative phase at the receiver for sounds entering the conduit at the first and second points depends on the relative time delay above, and the relative distance within the conduit from each point to the receiver location.

Figure 1A:
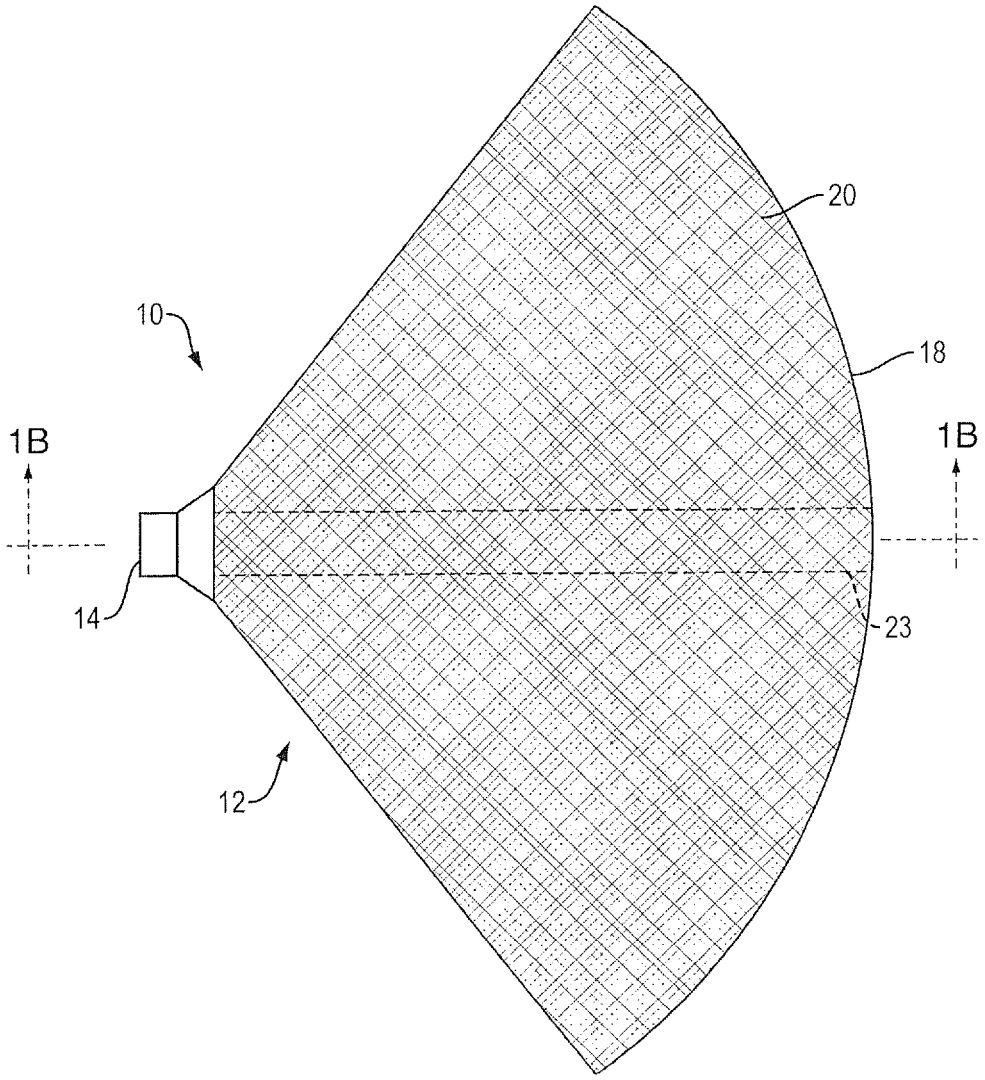
FIG. 1A is a schematic plan view of a directionally radiating acoustic device and FIG. 1B is a cross-section taken along line A-A.
Figure 1B:
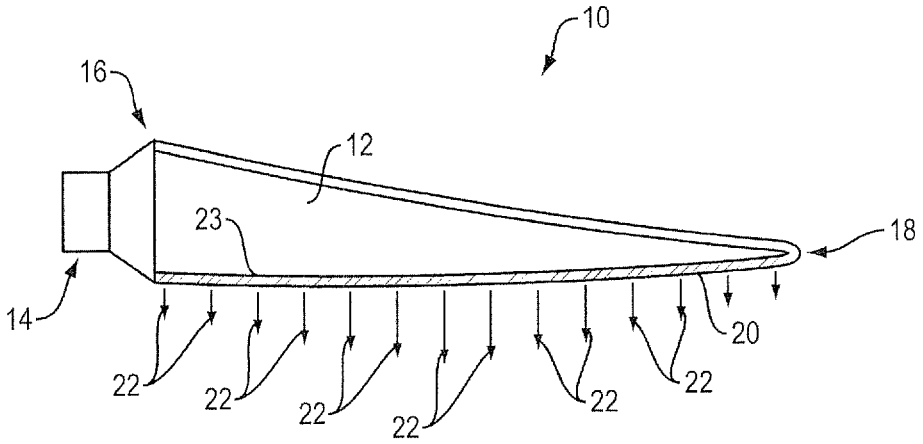

The shape of the structure's perimeter wall surface through which acoustic energy leaks (also called a "radiating section" or "radiating portion" herein) is arbitrary. In some examples, the perimeter wall surface (radiating portion) may be generally planar. One example of an arbitrarily shaped generally planar wall surface 20 is shown in FIGS. 1A and 1B. The cross hatched surface 23 of wall 20 represents the radiating portion through which acoustic volume velocity is radiated. Directionally radiating acoustic device 10 includes structure or conduit 12 to which loudspeaker (acoustic source) 14 is acoustically coupled at proximal end 16; the source couples to the conduit along an edge of the 2D projected shape of the conduit. Radiating portion 20 in this non-limiting example is the bottom surface of conduit 12, but the radiating surface could be on the top or on both the top and bottom surfaces of generally planar conduit 12. Arrows 22 depict a representation of acoustic volume velocity directed out of the conduit 12 through leak section 23 in wall 20 into the environment. The length of the arrows is generally related to the amount of volume velocity emitted. The amount of volume velocity emitted to the external environment may vary as a function of distance from the source. This is described in more detail elsewhere in this disclosure. For use as a receiver, source 14 would be replaced with one or more microphone elements, and the volume velocity would be received into rather than emitted from radiating portion 20.

Leak section 23 is a portion of the radiating portion of wall 20, and is depicted extending along the direction of sound propagation from speaker 14 toward conduit periphery 18. The following discussion of leak section 23 is also applicable to other portions of the radiating portion of wall 20. It is useful to only consider what is happening in section 23 for purposes of discussion, to better understand the nature of operation of the examples disclosed herein. Leak section 23 is depicted as continuous, but could be accomplished by a series of leaks aligned along the sound propagation direction (or sound reception direction for a receiver). Leak section 23 is shown in FIG. 1A as a rectangular strip extending in a straight line away from the location of speaker 14. This is a simplification to help illustrate the lengthwise extent of the radiating portion of wall 20. In general, a significant or in some examples the entire portion of surface 20 may be radiating, as illustrated by the cross-hatching. In some examples, the portion of surface 20 incorporating a leak may vary as a function of distance or angle or both from the location of a source (or sources in examples with more than one source). As described below the location, size, shape, acoustical resistance and other parameters of the leaks are variables that are taken into account to achieve a desired result, including but not limited to a desired directionality of sound radiation or sound reception.

Figure 2:
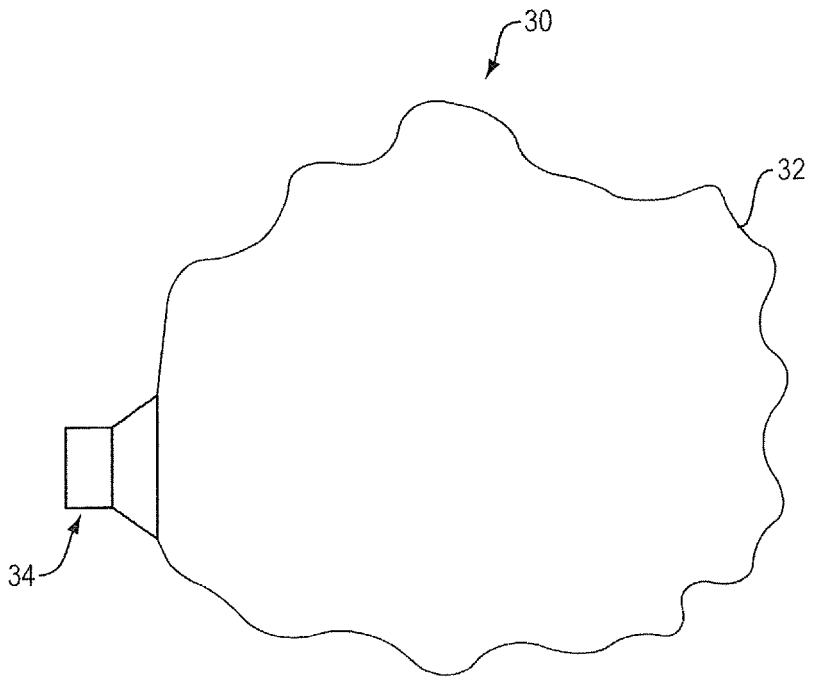
FIG. 2 is a schematic plan view of a directionally radiating acoustic device.

FIG. 2 illustrates directionally radiating acoustic device 30 with source 34 coupled to structure 32, which has an arbitrary shape.

Figure 3A:
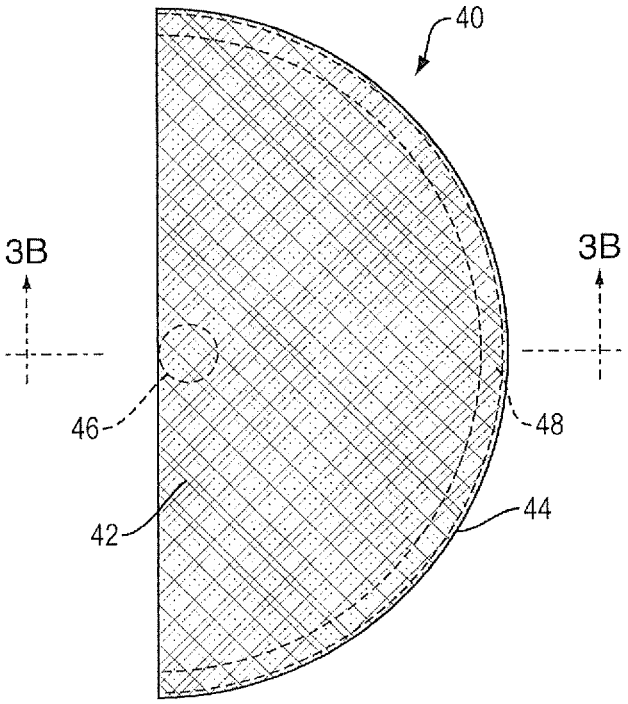
FIG. 3A is a schematic plan view of a directionally radiating acoustic device and FIG. 3B is a cross-sectional view taken along line B-B.
Figure 3B:
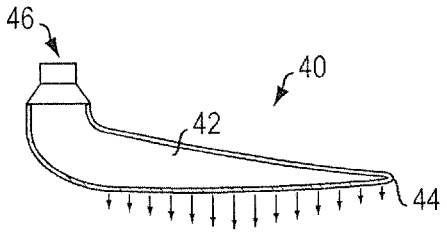

In one example of a directionally radiating acoustic device 40 as shown in FIGS. 3A and 3B, the source 46 (or, the receiver) is located above the radiating perimeter wall surface 42 of conduit 40, and the conduit curves down and away from the source to form a generally planar radiating perimeter wall surface (radiating portion) extending outward horizontally and ending at farthest extent 44. FIG. 3A illustrates leakage area section 48 (included within the dotted lines). Leak section 48 is shown in FIG. 3A as an arc shaped strip extending in a constant radius arc a fixed distance from the location of speaker 46. Section 48 is thus located at a constant time delay from the source, as further explained below. The illustration of section 48 is a simplification to help illustrate that sound emitted from such an arc will be emitted at the same time across the arc. In general, leak section 48 will extend over the surface 42 (crosshatched in the drawing), and will be present over a significant or in some examples the entire portion of surface 42. The portion of surface 42 incorporating a leak may vary as a function of distance or angle or both from the location of a source/receiver (or sources/receivers in examples with more than one source/receiver).

In another example (not shown), the radiating perimeter wall surface continues to curve in space as the conduit extends away from the source/receiver, in which case the radiating portion may not be generally planar, or may be only partially generally planar. The location of, degree of, and extent of curvature of the perimeter is not limited.

In some examples, the acoustic source/receiver couples to the conduit structure in a central location. In one example 50 shown in FIGS. 4A and 4B, the source 56 sits above the planar radiating perimeter wall section 52 of a circular shaped conduit with outer end 54. In another example 60, FIGS. 5A-5C, an arbitrarily shaped conduit 62 extends away from sources 66 and 68 generally horizontally over a 360 degree arc. Though the center is not explicitly defined in this example, a source/receiver can be generally located in line with the geometric center of the 2D projected conduit shape, (i.e. aligned with the geometric center when viewed in a 2D plan view). In some examples, the location where the source/receiver couples to the conduit structure is arbitrary and may have any relationship to the conduit shape. For example, neither of sources 66 and 68 are located at the geometric center of conduit 62 with perimeter 64.

The source/receiver is coupled into the conduit structure and the conduit structure is constructed and arranged such that the only path for the source acoustic energy coupled into the conduit structure to radiate to the outside environment (or for acoustic energy radiated into the conduit in a receiver) is through controlled leaks in the perimeter wall of the conduit structure. The acoustic impedance of the leaks (generally, this impedance is made primarily resistive and the magnitude of this acoustical resistance is determined) and position of the leaks and geometry of the conduit are chosen such that substantially all of the acoustic energy radiated into the conduit from the source is either dissipated by the acoustical resistance of the leaks or the energy is radiated to the outside environment through the controlled leaks in the perimeter walls of the conduit, by the time it reaches the end of the conduit. For a receiver, acoustic energy impinging on the outside surface of the conduit structure either radiates into the conduit or is dissipated into the resistance. By end, we generally mean that looking into the conduit from the position of the source (or receiver), the point along the conduit moving away from the source/receiver location at which the physical structure of the conduit stops. The end can also be thought of as a point along the conduit where the acoustic impedance seen by the propagating acoustic energy has a sharp transition in magnitude and/or phase. Sharp transitions in acoustic impedance give rise to reflections, and it is desired that substantially all of the acoustic energy in the conduit has been leaked to the outside environment or has been dissipated before the acoustic wave propagating within the conduit reaches the impedance transition, in order to reduce or eliminate the reflection. The elimination or substantial reduction of reflections of acoustic energy within the conduit along the direction of propagation results in elimination or substantial attenuation of standing waves within the conduit along the propagation direction. Reducing or eliminating standing waves within the conduit structure provides a smoother frequency response and a better controlled directivity.

The conduit shape, and the extent of (or area of and/or distribution across the perimeter wall of and/or thickness of) and the acoustical resistance of the leaks in the perimeter wall, are chosen such that an amount of acoustic volume velocity useful for affecting directional behavior is leaked through the substantially all portions of the leak area in the perimeter wall. For a leak to be considered to be radiating (outward or inward) a useful amount of volume velocity, we mean that the leak in question should radiate a volume velocity magnitude of at least 1% of the volume velocity magnitude radiated by the leak radiating the highest magnitude of volume velocity. It is possible, however, to choose leak parameters (location, area, extent, acoustical impedance (primarily acoustical resistance)) such that acoustical volume velocity useful for affecting directional behavior does not radiate through substantially all portions of the leak area. Useful directivity may still be obtained. However, the "effective extent" of the leak is limited to the portion of the leak that radiates useful acoustic energy. If a leak exists but no useful energy is radiated, then that section of the leak is not useful for controlling directional behavior and the effective extent of the leak is smaller than its physical extent. For example, if the acoustical resistance near the source location is too small, a large amount of the acoustical energy radiated by the source into the conduit will exit the conduit through the leak near the source, which will reduce the amount of acoustical energy available to be emitted through leaks located farther away from the source. The effectiveness of the downstream leaks will be negligible compared to the excessive energy radiated through the leak near the source. Leaks near the end of the conduit may no longer effectively emit any useful acoustic volume velocity. The extent of the radiating portion in the direction of propagation will typically be smaller than the physical extent of the conduit in the propagation direction.

Figure 6:
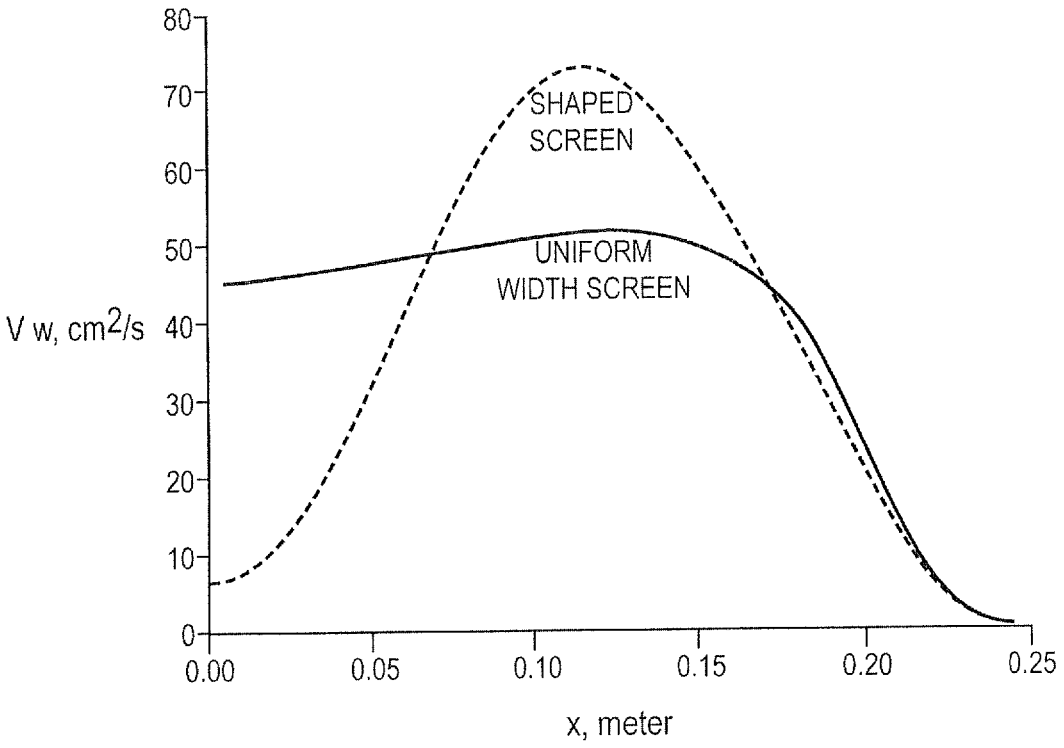
FIG. 6 shows windowing the output volume velocity through a resistive screen in a linear end fire line source, as a function of distance from the source.
Figure 7:
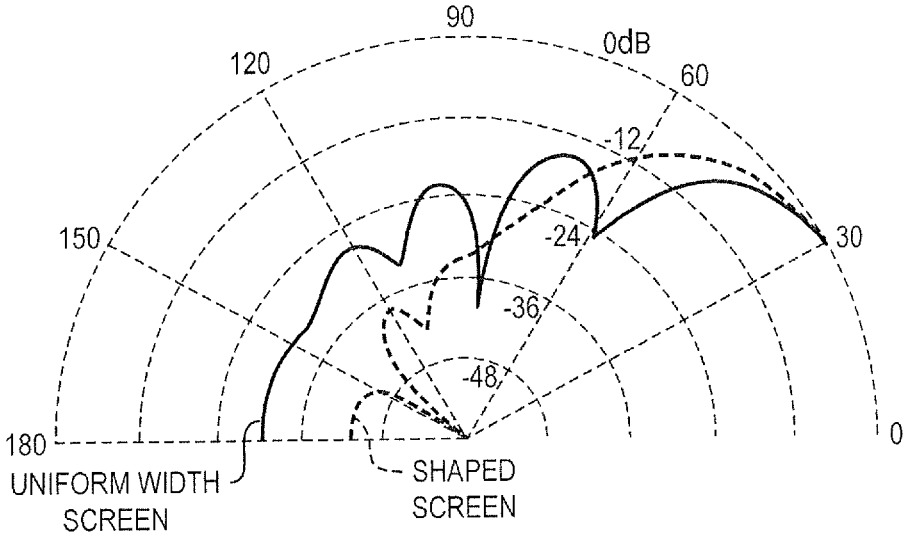
FIG. 7 shows the directivity effect of the windowing of FIG. 6.

In general, it is desirable for the acoustic volume velocity radiated through leaks to vary gradually as a function of distance along the conduit from the source or receiver location. Abrupt changes in radiated volume velocity over short distances may give rise to undesirable directional behavior. FIG. 6 and FIG. 7 show the effect of windowing the output volume velocity through a resistive screen in a linear end fire line source, as a function of distance from a source. FIG. 6 shows two curves. The first depicts the output volume velocity of an end fire line source device with a rectangular volume velocity profile (uniform width screen;

solid line curve) and the second curve depicts a similar device where the output volume velocity has been shaded (primarily by varying the width of the resistive leak in the perimeter wall of the device) to approximate a Hamming window function, except for x larger than 0.2 m where the screen width was kept constant to the end (shaped screen; dashed line curve). While not necessary, keeping the width of the leak constant to the end of the conduit helps ensure all the acoustic energy within the conduit leaks out through or is dissipated by the leak acoustical resistance before it reaches the end of the conduit. It can be seen in FIG. 7 that the side lobe levels are noticeably reduced for the device with the Hamming shaded output volume velocity (shaped screen; dashed line curve). While the graphs in FIGS. 6 and 7 depict the result of shading output volume velocity in a linear, end fire device, the principles arc applicable to all of the examples disclosed herein.

The magnitude of the volume velocity radiated should desirably but not necessarily reach a maximum somewhere near the middle of the distance between the source/receiver and end of the conduit (or, the end of the radiating portion of the conduit), generally smoothly increasing from the source/receiver location to the point of maximum radiation, and generally smoothly decreasing from the point of maximum radiation to the end. This behavior can be thought of as providing a window function on the volume velocity radiated as a function of distance from the source/receiver. Various window functions can be chosen [e.g. Hanning, Hamming, ½ cos, uniform rectangular, etc.], and the disclosure is not limited in the window functions used. Various window functions allow a tradeoff to be made between the main radiation lobe and side lobe behavior. One can trade off obtaining higher main lobe directivity for increased side lobe energy (assuming a fixed leak extent), or can accept reduced main lobe directivity for reduced side lobe energy. Windowing can also be accomplished in the direction that is orthogonal to the propagation direction, such that there is more volume velocity radiated in the center of the device and less moving out toward the sides of the device. For example, in some cases the locations along the conduit with a constant time delay relative to the location of the source or receiver fall along an axis (e.g., a circular arc), and the acoustic volume velocity radiated through leaks varies gradually as a function of distance along this axis, from a point on the axis.

The previously described structures control the directivity of the emitted or received acoustic energy in two ways. The first manner of directivity control we refer to as end fire directional control. End fire directional control devices are described in prior U.S. Pat. Nos. 8,351,630; 8,358,798; and 8,447,055, the disclosures of which are herein incorporated by reference in their entirety. The end fire directional control arises because the perimeter wall with a leak having acoustical resistance extends in the direction of sound propagation within the conduit structure, effectively forming a continuous linear distribution of acoustic sources. One simplified example is leak 23, FIG. 1A. Because sound propagates away from the source within the conduit (or "pipe" as it is referred to for example in U.S. Pat. No. 8,351,630), the outputs from the linear distribution of acoustic sources (formed by the perimeter leaks to the external environment) do not occur at the same time along the length of the conduit. Acoustic energy emitted to the external environment through conduit perimeter wall leaks located closer to the acoustic source location is emitted before acoustic energy is emitted to the external environment through leaks located farther away from the acoustic source location. The acoustic energy emitted from the linear distribution of sources sums coherently in the direction pointing from the acoustic source location along the length of the conduit. We will refer to a device with the linear distribution of sources exhibiting the above behavior as an end fire line source. An end fire line receiver exhibits reciprocal behavior.

The energy emitted/received by an end fire line source/receiver sums coherently in a direction pointing away from the acoustic source location along the direction of the conduit length because the propagation speed of sound within the conduit essentially matches the propagation speed of sound in the external environment. If, however, the output or input from all the leaks in the perimeter wall occurred at the same time, the output/reception pattern from the source/receiver device would have a "broadside" orientation, rather than end fire. It is the relative time delay for leaks distributed linearly along the length of the conduit perimeter wall that provides the end fire line source/receiver directional behavior.

Another method of directional control obtained by examples disclosed herein is similar to the broadside directivity mentioned earlier. In the examples described herein, this method of directional control is combined with the end fire method described above. In this method of directional control, the "extent" or size of the leaks in the perimeter wall of the conduit is expanded to form an "end fire surface source" or end fire surface receiver, as opposed to the end fire line source/receiver described earlier. In an end fire surface source or receiver (i.e., device), end fire behavior is still present. However, the end fire surface device is arranged to additionally control directivity in a dimension different to the end fire direction, which is generally orthogonal to the end fire direction. Note, however, that orthogonality is not a requirement. For ease of description however, going forward this additional dimension of directional control will be referred to as the orthogonal direction. To accomplish this, the perimeter wall leak through the conduit with an arbitrary, fixed time delay is constructed and arranged to have an "extent" (e.g., length) that is significant in size with respect to the wavelength of sound for the lowest frequency for which this end fire surface method of directivity control is desired. In general, when the extent of the fixed time delay leak is approximately ½ wavelength of sound at the lowest frequency that it is desired to control directivity, the end fire surface device will start to provide useful directivity control in the orthogonal direction to the end fire direction. In general, useful end fire directivity control begins when the size of the perimeter leak in the end fire direction is approximately equal to ¼ wavelength. By useful, we mean that the directional device has reduced output or input in a direction where radiation is unwanted by at least 3 dB compared to the output or input of the acoustic source or receiver operating without the directional device, when measured in the far field.

When the acoustic source/receiver that is coupled to the conduit can be approximated by a simple point element, such as would be the case where a single, electroacoustic transducer or microphone was coupled, the "extent" of a planar end fire surface at a fixed time delay will be a circular arc section, such as leak 48, FIG. 3A. In this case, the directivity control in the orthogonal direction occurs when the arc length is approximately ½ wavelength. It should be noted that the length of the arc section above is determined by the shape of the conduit, and the time delay at which the arc length is evaluated. For a longer time delay, sound emitted from the source will have traveled a greater distance, and the radius of the arc section will be larger, which means the arc section length is larger. This is limited by the length of the conduit in the end fire direction. The distance from the source to the end of the conduit controls the largest radius possible for a given structure. The above description holds for a planar geometry but does not necessarily hold for more complex 3D shell shapes that are described below. Also, if the acoustic source/receiver has a different configuration and is not approximated by a simple monopole, the extent of the conduit at a fixed time delay may not be a circular arc.

In some examples, it is desirable for the frequency ranges of end fire directional control and orthogonal dimension directional control to substantially overlap. In these examples, the length of the perimeter leak in the end fire direction is constructed and arranged to be on the same order as the (maximum) extent of the leak for the fixed time delay. In one example of a device having the shape of a circular section, the radius of the section and the arc length at maximum time delay are chosen to be on the same order of magnitude. In some examples, these are chosen to be the same. For the same frequency range of directional control, the arc length of the leak at maximum available time delay (i.e., at the end of the conduit) should be approximately twice the length as the length of the perimeter leak in the end fire direction. As mentioned previously, useful directivity control is obtained when the end fire perimeter leak length is ¼ wavelength, and when the arc length at maximum constant time delay is ½ wavelength.

In some examples, useful behavior is obtained if there is up to an octave difference in the frequency range of end fire directional control and the orthogonal direction directivity control. In some examples, the ratio of the arc length at maximum time delay to the perimeter wall leak length in the end fire direction is chosen to be between 1 and 4, which results in the frequency range of directional control in the end fire and orthogonal directions being within one octave of each other.

In some examples, useful behavior is obtained if there is up to a three octave difference in the frequency ranges of directivity control. Other relationships are also possible and are included within the scope of this disclosure.

For a planar device with end fire perimeter leak length r, the maximum arc length possible for constant time delay is for a 360 degree circular planar device, where the arc length is the circumference of the device at radius r. This gives a maximum ratio constant time delay leak arc length to end fire perimeter leak length of approximately 6.28. As the angle the planar circular conduit subtends is reduced, this maximum ratio is further reduced. For example, for a 180 degree subtended semi-circular radiating surface, the maximum are length at constant time delay is reduced to 3.14 times the end fire perimeter leak length. For end fire surfaces in general, the subtended angle for the radiating surface should be at least 15 degrees to obtain any useful directivity control benefit over simple linear end fire devices. The ratio of arc length to end fire perimeter leak length for a circular conduit subtending angle of 15 degrees is 0.25.

Figure 4A:
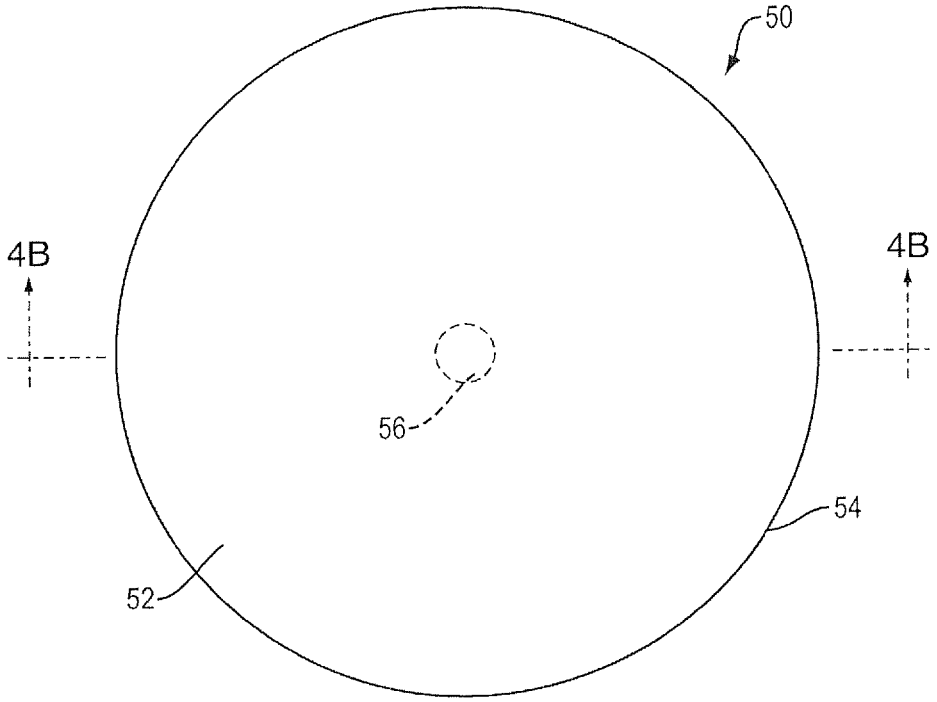
FIG. 4A is a schematic plan view of a directionally radiating acoustic device and FIG. 4B is a cross-sectional view taken along line C-C.
Figure 4B:
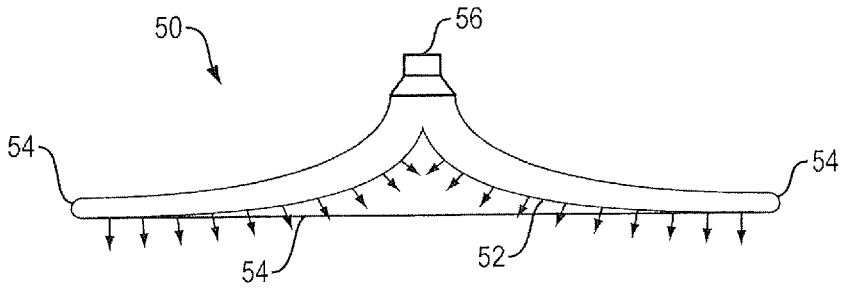
Figure 5A:
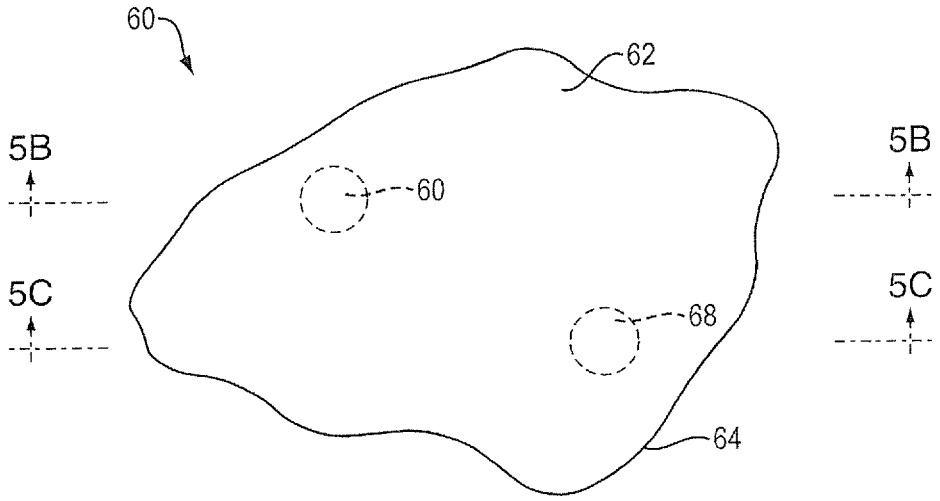
FIG. 5A is a schematic plan view of a directionally radiating acoustic device and FIGS. 5B and 5C are cross-sectional views taken along lines D-D and E-E, respectively.
Figure 5B:
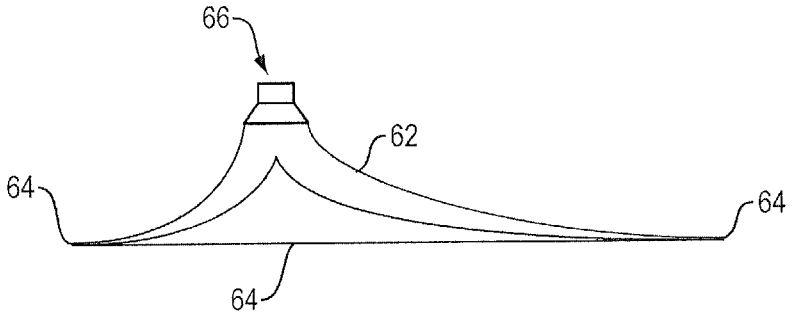
Figure 5C:
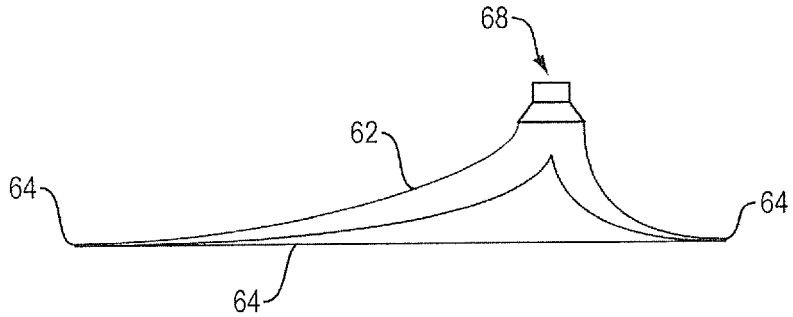

Examples of end fire surface sources are shown in FIGS. 1 and 3. In FIGS. 1A and 3, the conduit extends in a generally semi-circular manner from the source location. FIG. 3 shows a full ½ circle conduit where FIG. 1 shows a conduit spanning slightly less than ½ circle. FIG. 1 also shows an acoustic source essentially in the plane of the planar conduit whereas the source in FIG. 3 is located above the plane of the planar conduit and a section of the conduit conducts energy from the raised source into the planar section. The leaks in the perimeter walls occur over a semi-circular generally planar section. The extents of the fixed time delay leaks in these examples are circular arc sections. The arc length for circular sections of arbitrary angle is easily calculated. The example of FIG. 1A shows a semicircular end fire surface source. In some examples, the end fire surface device has a generally planar radiating section that is an arbitrary circular section. For example, the end fire acoustic device may be a ½ circular section, ⅛ circular section, ½ circular section (as shown in FIG. 3A), ¾ circular section, or a full circular section as shown in FIG. 4A. Any circular section is contemplated herein.

The source/receiver may be located generally in the plane of the planar radiating section of the conduit, as shown in FIGS. 1 and 2, or it may be displaced above or below the generally planar section, as shown in FIG. 3.

Examples of end fire surface devices are not limited to semi-circular or circular geometry. In some examples, the generally planar section of the conduit may have an arbitrary shape, as shown in FIG. 2. The source/receiver may be located generally in the plane of the planar radiating section of the conduit, or displaced above or below it. The source/receiver may couple to the conduit at or near the geometric center of the arbitrarily shaped planar section, or may be offset from this center. There may be one or more acoustic sources/receivers that are acoustically coupled to the conduit.

Figure 8:
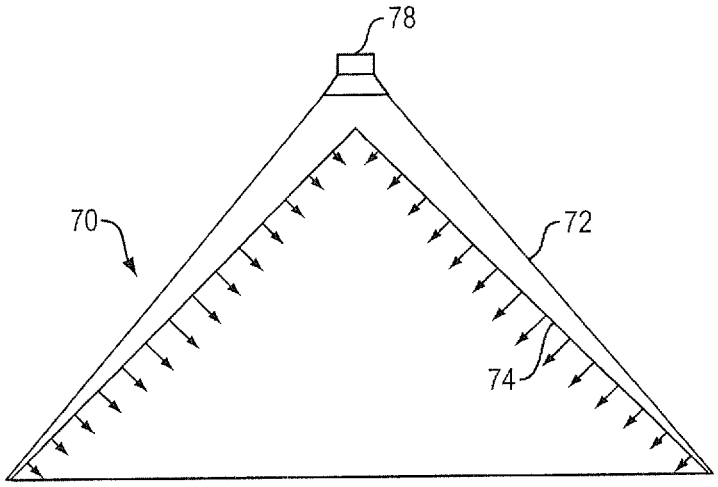
FIG. 8 is a schematic cross-sectional view of a directionally radiating acoustic device.

In the above end fire surface device examples, the conduit is described as having a generally planar radiating section where the planar section has leaks distributed about its perimeter wall to radiate acoustic energy from within the conduit to the outside environment, or from the environment into the conduit, through the leaks. In some examples, a portion of or all of this radiating section with perimeter wall leaks is curved into a three dimensional shape such that the radiating section can no longer be described as generally planar. In these examples, the device is referred to as an end fire shell device (i.e., source or receiver). Examples of end fire shell sources are shown in FIGS. 4, 5 and 8 (FIG. 8 illustrates a conical geometry, though this shape is not limiting). Curving the perimeter of the conduit section with controlled leaks into a three dimensional surface provides further control of the directivity of the device since the output or input volume velocity is no longer confined to a plane. The curvature can be used to broaden the end fire directivity control, particularly at higher frequencies where endfire devices tend to have relatively narrow directivity patterns.

In some examples, the perimeter wall surface though which acoustic energy leaks may be curved into a 3D surface. One example surface that has the benefit of being somewhat simpler to manufacture is conical, such as conical conduit surface 72 of directionally radiating acoustic device 70, FIG. 8. In this example sound from source 78 is leaked through lower surface 74, although the surfaces may be reversed such that sound leaks through the upwardly-facing wall. In some examples the device may also be just a portion of a conical structure, such as 180 degrees of the conical device of FIG. 8.

U.S. Pat. No. 8,351,630, for example, describes examples of end fire line sources. It describes a cross section of the "pipe" (the "pipe" term used in U.S. Pat. No. 8,351,630 generally corresponds to the "conduit" term used herein) normal to the direction of propagation of acoustic energy within the "pipe" may change along the length of the "pipe", and more specifically may decrease with distance from the source. This was described as a way to keep the pressure within the "pipe" more constant along the length of the "pipe" as energy leaked out of the pipe to the outside environment.

In end fire surface and end fire shell devices, as energy leaks through or is dissipated in the resistance of the leaks, it may be desirable to keep the acoustic pressure within the conduit approximately constant. However, it may also be the case that constant pressure is not needed but it is desirable to alter the geometry of the conduit to reduce the pressure drop that would otherwise occur if the cross sectional area were unchanged. In end fire surface and end fire shell devices, the extent of the leak is substantially larger than the extent of leaks in the end fire line device. In the end fire surface device and end fire shell device examples, because the extent of the constant time delay leak is approximately ½ wavelength of the lowest frequency of directional control (which is substantially greater than the extent of the constant time delay leak in the end fire line source examples), the variation of cross sectional area of the conduit described in U.S. Pat. No. 8,351,630 for the end fire line source would not be sufficient to maintain useful operation of end fire surface and end fire shell devices. This is because the depth of the conduit does not decrease fast enough as a function of distance from the source/receiver to compensate for the extra energy leaked through the perimeter as a function of distance, because the extent in the constant time delay dimension is substantially greater than in the linear case. Because of the increase in the extent in the constant time delay direction, reducing the depth of the conduit as a function of distance from the source/receiver in the propagation direction required in order to keep the pressure in the conduit relatively constant would cause the depth of the conduit to become too shallow for sound propagation without excessive viscous losses to the walls.

To avoid having all of the acoustic energy leak out of the conduit too close to the location of the source in the end fire surface and end fire shell sources, one or more of the following approaches can be followed. All else being equal, the cross-sectional area of the conduit at a constant distance from the source (a constant time delay section) must decrease much faster along the direction away from the source than the cross section in the prior art end fire line source case. This can become problematic because as the extent of the fixed time delay leak increases, the depth of the conduit must get extremely small. Propagation within a conduit having such a shallow depth can give rise to non-linear propagation behavior which would be undesirable. The conduit itself would begin to impede the flow of acoustic energy (i.e., it would exhibit viscous loss), and acoustical energy would be dissipated in this conduit viscous loss. Any energy dissipated in the conduit viscous loss is no longer useful for directivity control, and the efficiency of the device would be reduced.

To avoid the problems that arise with very shallow depths, in some examples the amount of energy leaked through the perimeter wall leak is varied as a function of distance from the source/receiver location. This can be accomplished by varying the area of the leak as a function of distance from the source/receiver, by varying the acoustical resistance of the leak as a function of distance from the source/receiver, or both in combination. In general, the area of the leak is made small near the source/receiver and/or the acoustic resistance of the leak is made high near the source/receiver, and the area of the leak is gradually increased as distance from the source/receiver increases and/or the resistance of the leak is made lower as distance from the source/receiver increases. This can effectively be accomplished by placing a material with spatially varying acoustical resistance over a leak opening in the perimeter with constant area as a function of distance from the source/receiver, by varying the leak area as a function of distance from the source/receiver and applying a material with constant acoustical resistance over the leak, or by varying the area and using material with varying acoustical resistance. Additionally, the acoustical resistance and leak area of the perimeter can be directly controlled by forming in some manner (for example using a photolithographic method) etched areas of the perimeter wall of the conduit with the location, size and shape of the etch holes controlled to control acoustical resistance of the perimeter wall surface.

Figure 9A:
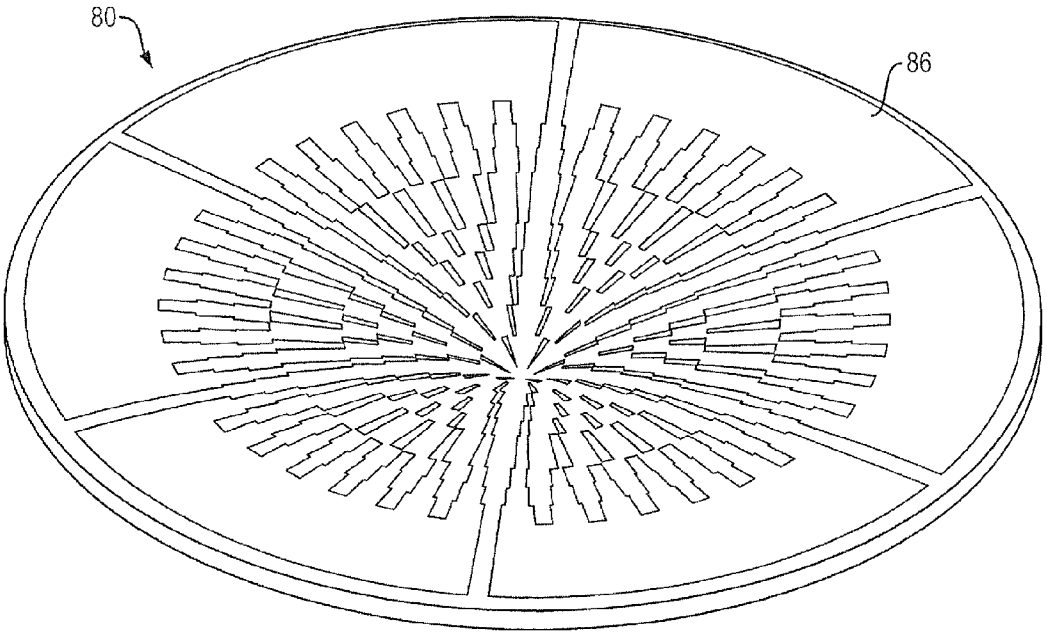
FIG. 9A is a schematic view of a directionally radiating acoustic device and FIG. 9B is a cross-sectional view thereof.
Figure 9B:
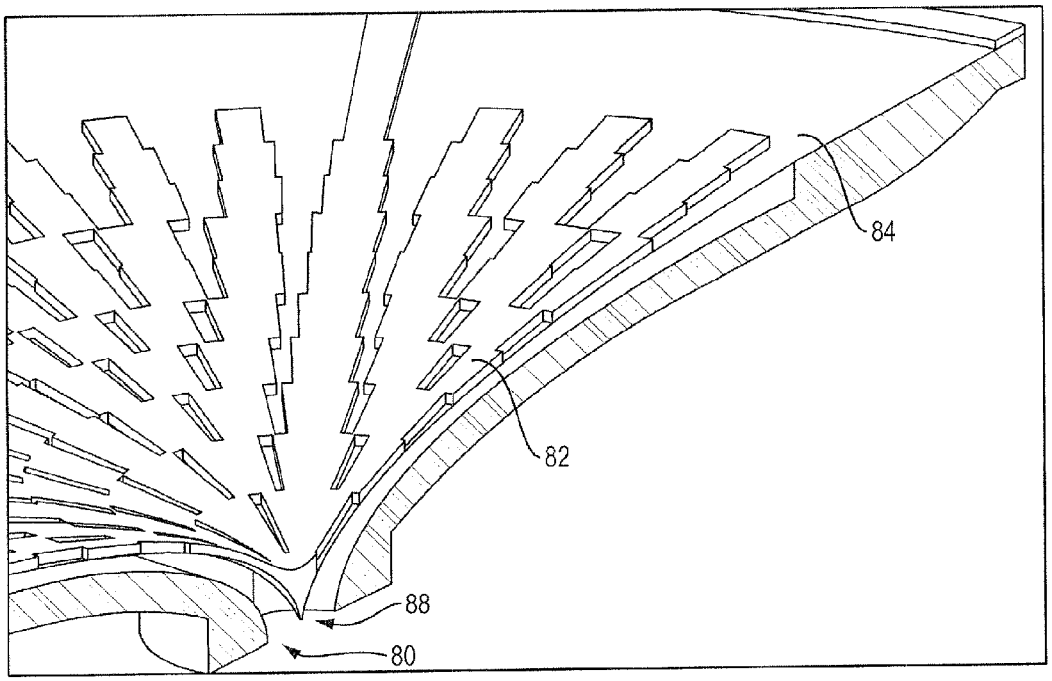

One example of using a masking material to alter the percentage of area of the leak as a function of distance from the source is shown in device 80, FIG. 9A. FIG. 9B shows the device 80 of FIG. 9A sectioned in half. Device 80 emits volume velocity through upper radiating portion 86. A transducer would be coupled at location 88. In these figures, the white areas 82 are masked with an acoustically opaque material so that volume velocity does not leak from the conduit through these sections. The other cross-hatched areas 84 have acoustical resistance, and volume velocity from the conduit can be leaked through these areas. Areas 84 could be formed by use of an acoustically resistive screen or mesh material, while areas 82 may be created by covering portions of the mesh material with an acoustically opaque material. Non-limiting examples of a selectively-masked resistive surface are further described below in conjunction with FIGS. 10A and 10B. Alternatively, material with variable acoustical resistance could be used, for example a woven material where the tightness of the weave varied spatially. It can be seen that very little area near the center (which is the source location 88) is available for leakage, and progressively more area is available for leakage of volume velocity as the distance from the source location increases. It can also be seen that the masking in this example has a regular, rectangular pattern. This was only done for convenience in fabrication; other patterns are contemplated herein. The concepts illustrated in FIGS. 9A and 9B can be applied to a directional receiver.

Figure 10A:
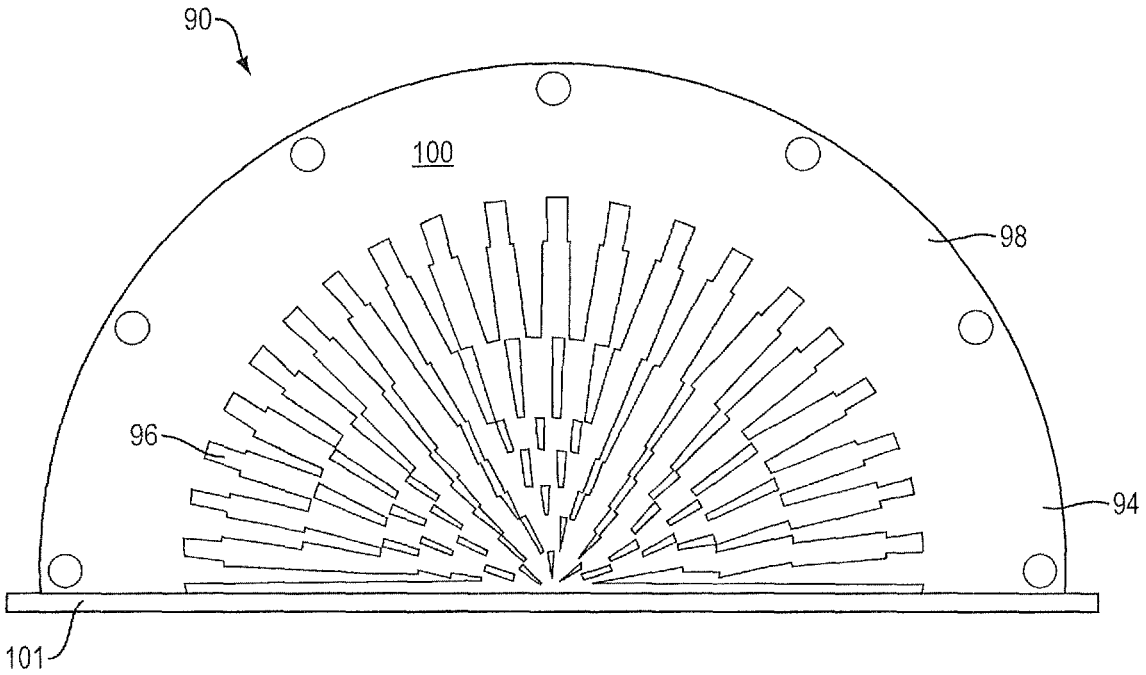
FIGS. 10A and 10B are top and bottom plan views, respectively, of a directionally radiating acoustic device.
Figure 10B:
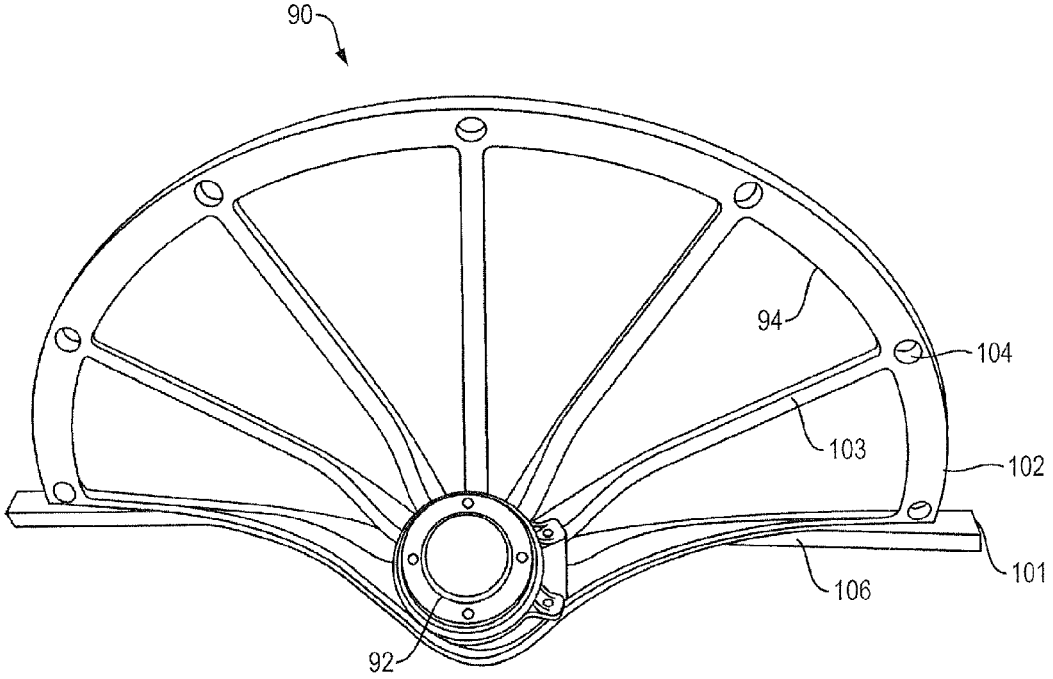

FIGS. 10A and 10B show bottom and top views respectively of a complete assembly of a generally semi-circular end fire shell source 90 with masked perimeter to control the leak area, and single loudspeaker source 92 which mounts above the conduit 94. Stiffening structure 106 may comprise a base 101, a semi-circular peripheral portion 102, and radial ribs 103. Holes 104 may be included to provide for mounting to a surface such as a wall or ceiling. Patterned areas 96 are masked with an acoustically opaque material while remainder 98 of conduit surface 100 comprises the radiating portion that may comprise a resistive screen.

Before the sound waves reach the external environment, they pass through resistive screen 98. The resistive screen 98 may include one or more layers of a mesh material or fabric. In some examples, the one or more layers of material or fabric may each be made of monofilament fabric (i.e., a fabric made of a fiber that has only one filament, so that the filament and fiber coincide). The fabric may be made of polyester, though other materials could be used, including but not limited to metal, cotton, nylon, acrylic, rayon, polymers, aramids, fiber composites, and/or natural and synthetic materials having the same, similar, or related properties, or a combination thereof. In other examples, a multifilament fabric may be used for one or more of the layers of fabric.

In one example, the resistive screen 98 is made of two layers of fabric, one layer being made of a fabric having a relatively high acoustic resistance compared to the second layer. For example, the first fabric may have an acoustic resistance ranging from 200 to 2,000 Rayls, while the second fabric may have an acoustic resistance ranging from 1 to 90 Rayls. The second layer may be a fabric made of a coarse mesh to provide structural integrity to the resistive screen, and to prevent movement of the screen at high sound pressure levels. In one example, the first fabric is a polyester-based fabric having an acoustic resistance of approximately 1,000 Rayls (e.g., Saatifil® Polyester PES 10/3 supplied by Saati of Milan, Italy) and the second fabric is a polyester-based fabric made of a coarse mesh (e.g., Saatifil® Polyester PES 42/10 also supplied by Saati of Milan, Italy). In other examples, however, other materials may be used. In addition, the resistive screen may be made of a single layer of fabric or material, such as a metal-based mesh or a polyester-based fabric. And in still other examples, the resistive screen may be made of more than two layers of material or fabric. The resistive screen may also include a hydrophobic coating to make the screen water-resistant.

The acoustically resistive pattern 96 may be applied to or generated on the surface of the resistive screen. The acoustically resistive pattern 96 may be a substantially opaque and impervious layer. Thus, in the places where the acoustically resistive pattern 96 is applied, it substantially blocks the holes in the mesh material or fabric, thereby creating an average acoustic resistance that varies as the generated sound waves move radially outward through the resistive screen 98 (or outward in a linear direction for non-circular and non-spherical shapes). For example, where the acoustic resistance of the resistive screen 98 without the acoustically resistive pattern 96 is approximately 1,000 Rayls over a prescribed area, the average acoustic resistance of the resistive screen 98 with the acoustically resistive pattern 96 may be approximately 10,000 Rayls over an area closer to the electro-acoustic driver 92, and approximately 1,000 Rayls over an area closer to the edge 102 of the loudspeaker (e.g., in areas that do not include the acoustically resistive pattern 96). The size, shape, and thickness of the acoustically resistive pattern 96 may vary, and just one example is shown in FIGS. 10A and 10B.

The material used to generate the acoustically resistive pattern 96 may vary depending on the material or fabric used for the resistive screen 98. In the example where the resistive screen 98 comprises a polyester fabric, the material used to generate the acoustically resistive pattern 96 may be paint (e.g., vinyl paint), or some other coating material that is compatible with polyester fabric. In other examples, the material used to generate the acoustically resistive pattern 96 may be an adhesive or a polymer. In still other examples, rather than add a coating material to the resistive screen 98, the acoustically resistive pattern 96 may be generated by transforming the material comprising the resistive screen 98, for example by heating the resistive screen 98 to selectively fuse the intersections of the mesh material or fabric, thereby substantially blocking the holes in the material or fabric.

An exemplary process for making loudspeakers as described herein is described in U.S. patent application Ser. No. 14/674,178, entitled "Method of Manufacturing a Loudspeaker" filed on Mar. 31, 2015, the entire contents of which are incorporated herein by reference.

In some examples, end fire surface and end fire shell devices are mounted on or adjacent to one or more wall or ceiling surfaces in a room. In these examples, leaks in the perimeter wall can be arranged to emit sound into or receive sound from the interior volume of the room. The radiation may be directed toward or received from the floor of the room, or elsewhere in the room, as desired. In these examples, the devices can have a single sided behavior. That is, acoustic energy is leaked through only one side of the planar or shell surface.

Figure 11A:
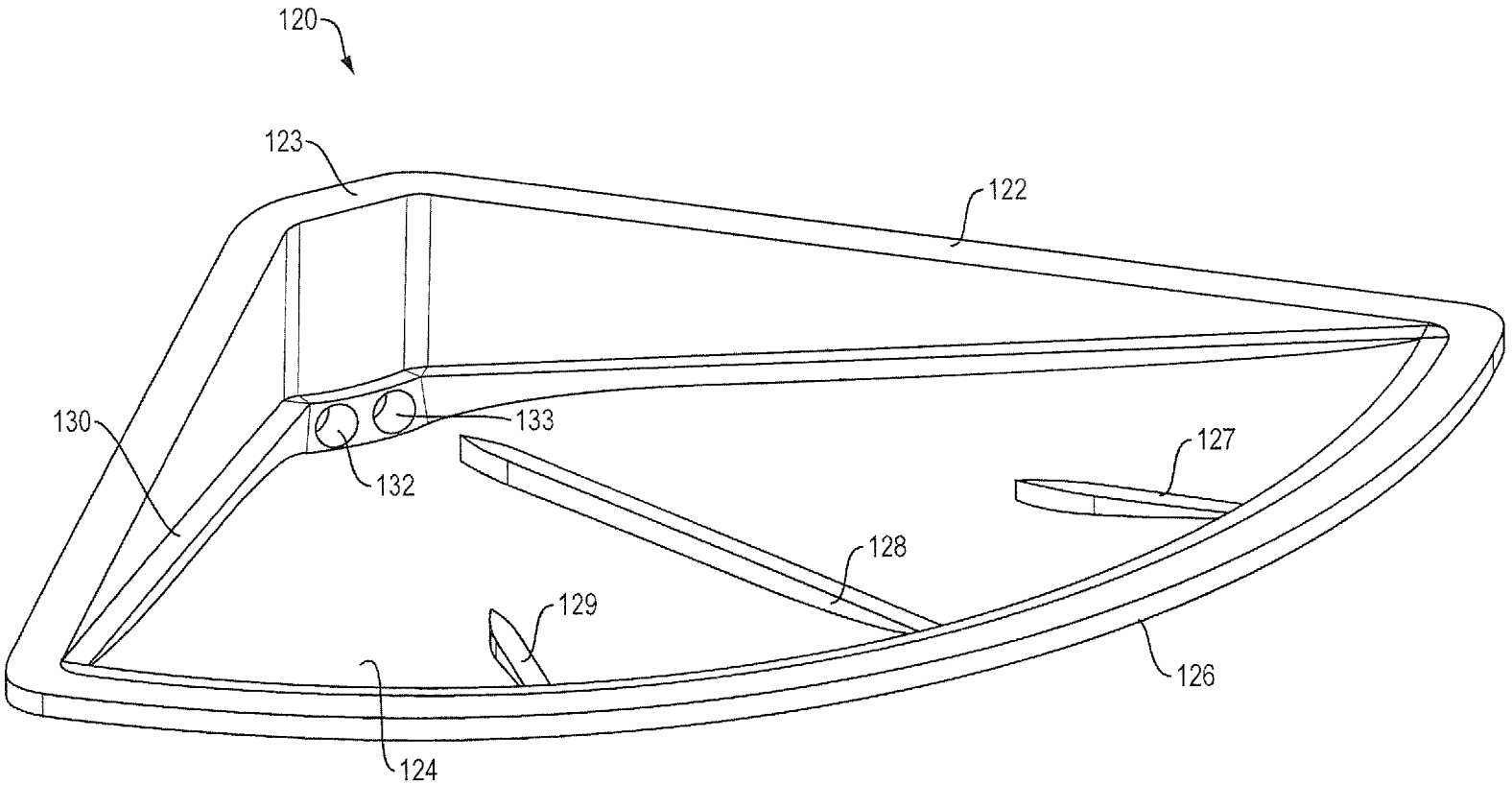
FIGS. 11A and 11B are top and bottom perspective views of the housing for a directional receiving device.
Figure 11B:
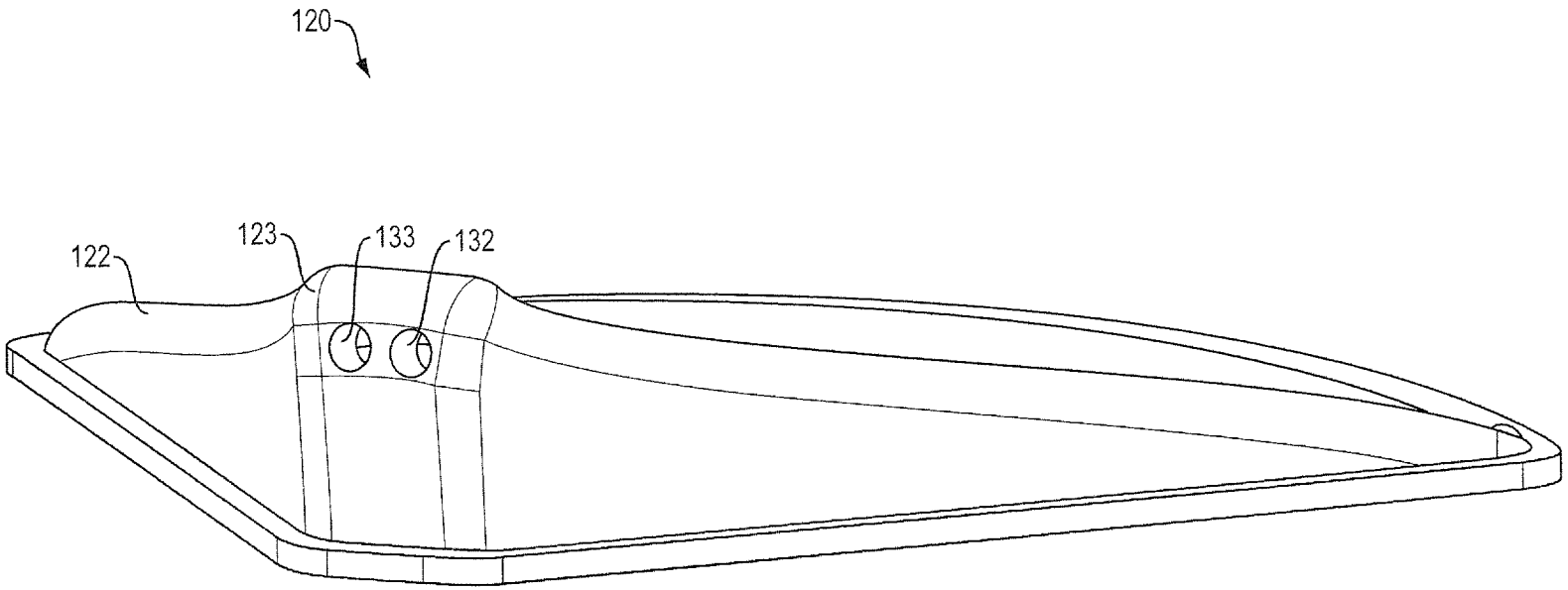

An exemplary end fire shell acoustic receiver is shown in FIGS. 11A and 11B. Device 120 comprises housing 122 with openings 132 and 133 that hold microphone elements. There can be one, two or more microphone elements. Device 120 has a generally ¼ circle profile, subtending an angle of about 90 degrees. End/sidewalls 123 allow the device to be pitched downward, but this is not a necessary feature. Peripheral flange 126 provides rigidity. Ribs 127-129 that project above solid wall 124, along with interior shelf 130, define a surface on which a resistive screen (not shown) is located. The screen accomplishes the leaks. The screen can be of the type described above relative to FIGS. 9 and 10. The conduit is formed between this screen and wall 124. As can be seen, from peripheral wall 126 to the microphone location the depth of the conduit progressively increases.

A number of implementations have been described. Nevertheless, it will be understood that additional modifications may be made without departing from the scope of the inventive concepts described herein, and, accordingly, other embodiments are within the scope of the following claims.

What is claimed is:

1. A directional acoustic device comprising:

an acoustic source or an acoustic receiver;

a conduit to which the acoustic source or acoustic receiver is acoustically coupled and within which acoustic energy travels in a propagation direction from the acoustic source or to the acoustic receiver, the conduit having finite extent at which the conduit structure ends;

wherein the conduit has a radiating portion that has a radiating surface with leak openings that define controlled leaks through which acoustic energy radiated from the source into the conduit can leak to the outside environment or through which acoustic energy in the outside environment can leak into the conduit;

wherein the only path for acoustic energy in the conduit to reach the external environment or acoustic energy in the external environment to enter the conduit is through the controlled leaks;

wherein the leak openings define leaks having a first extent in the propagation direction, and also define leaks having a second extent at locations along the conduit with a constant time delay relative to the location of the source or receiver;

wherein the extents of the leaks are determinative of the lowest frequency where useful directivity control is obtained; and wherein the lowest frequency of directivity control for the leak in the propagation direction is within 3 octaves of the lowest frequency of directivity control for the leak with constant time delay.

2. The device of claim 1 wherein the radiating portion of the conduit is generally planar.

3. The device of claim 2 wherein the radiating portion of the conduit has an end that lies along a circular arc.

4. The device of claim 2 wherein the radiating portion of the conduit is a circular sector.

5. The device of claim 1 wherein the radiating portion of the conduit lies generally in a plane, and wherein the source or receiver is located in the plane of the radiating portion.

6. The device of claim 1 wherein the radiating portion of the conduit lies generally in a plane, and wherein the source or receiver is not located in the plane of the radiating portion.

7. The device of claim 1 wherein the radiating portion of the conduit is curved to form a three-dimensional shell.

8. The device of claim 1 wherein the area of the leak openings that define leaks in the propagation direction varies as a function of distance from the location of the acoustic source or receiver.

9. The device of claim 8 wherein the acoustic resistance of the leak openings that define leaks in the propagation direction varies as a function of distance from the location of the acoustic source or receiver.

10. The device of claim 1 wherein the acoustic resistance of the leak openings that define leaks in the propagation direction varies as a function of distance from the location of the acoustic source or receiver.

11. The device of claim 10 wherein the variation in acoustic resistance is accomplished at least in part by one or both of: varying the area of the leak as a function of distance from the source or receiver; and by varying the acoustical resistance of the leak as a function of distance from the source or receiver.

12. The device of claim 10 wherein the variation in acoustic resistance is accomplished at least in part by one or both of: placing a material with spatially varying acoustical resistance over a leak opening in the perimeter with constant area as a function of distance from the source or receiver; and by varying the leak area as a function of distance from the source or receiver and applying a material with constant acoustical resistance over the leak.

13. The device of claim 1 wherein the depth of the conduit, at locations where the time delay relative to the source or receiver location is constant, decreases as a function of distance from the source or receiver location.

14. The device of claim 1 wherein the extent of the leak openings that define constant time delay leaks is between about one and four times the extent of the leak openings that define leaks in the propagation direction.

15. The device of claim 1 wherein the ratio of the first extent to the second extent is less than 6.3 and greater than 0.25.

16. The device of claim 1 wherein the extent of the fixed time delay leak is at least about ½ wavelength of sound at the lowest frequency that it is desired to control directivity.

17. The device of claim 1 wherein the extent of the leak in the propagation direction is at least about ¼ wavelength of sound at the lowest frequency that it is desired to control directivity.

18. The device of claim 1 wherein the leak openings are all in one surface of the conduit.

19. The device of claim 18 wherein the conduit is mounted to the ceiling of a room, and the surface with leaks faces the floor of the room.

20. The device of claim 18 wherein the conduit is mounted on a wall of a room and the surface with leaks faces the floor of the room.

21. The device of claim 1 wherein the acoustic volume velocity radiated through the leaks varies gradually as a function of distance along the conduit from the source or receiver.

22. The device of claim 1 wherein the locations along the conduit with a constant time delay relative to the location of the source or receiver fall along an axis, and wherein the acoustic volume velocity radiated through leaks varies gradually as a function of distance along this axis, from a point on the axis.

23. A directionally radiating acoustic device, comprising:

an acoustic source or receiver;

a conduit to which the acoustic source or receiver is acoustically coupled and within which acoustic energy travels in a propagation direction from the acoustic source or to the acoustic receiver, the conduit having finite extent at which the conduit structure ends;

wherein the conduit has a radiating portion that has a radiating surface with leak openings that define controlled leaks through which acoustic energy radiated from the source into the conduit can leak to the outside environment, or through which acoustic energy in the outside environment can leak into the conduit;

wherein the only path for acoustic energy in the conduit to reach the external environment or acoustic energy in the external environment to enter the conduit is through the controlled leaks;

wherein the radiating portion of the conduit expands radially out from the location of the source or receiver over a subtended angle;

wherein the depth of the conduit decreases as distance from the acoustic source or receiver increases; and wherein the subtended angle is at least 15 degrees.

24. A directionally radiating acoustic device comprising:

an acoustic source or receiver;

a conduit to which the acoustic source or receiver is acoustically coupled and within which acoustic energy travels in a propagation direction from the acoustic source or to the acoustic receiver, the conduit having finite extent at which the conduit structure ends;

wherein the conduit has a radiating portion that has a radiating surface with leak openings that define controlled leaks through which acoustic energy radiated from the source into the conduit can leak to the outside environment, or through which acoustic energy in the outside environment can leak into the conduit;

wherein the only path for acoustic energy in the conduit to reach the external environment or acoustic energy in the external environment to enter the conduit is through the controlled leaks;

wherein the leak openings define leaks having a first extent in the propagation direction, and also define leaks having a second extent at locations along the conduit with a constant, maximum time delay relative to the location of the source or receiver; and wherein the ratio of the first extent to the second extent is less than 6.3 and greater than 0.25.

* * * * *